US011259984B2

(12) United States Patent
Michelena et al.

(10) Patent No.: US 11,259,984 B2
(45) Date of Patent: Mar. 1, 2022

(54) RECIPROCATING ROLLATOR

(71) Applicant: MEDLINE INDUSTRIES, LP, Northfield, IL (US)

(72) Inventors: Alberto Michelena, Highlands Ranch, CO (US); Allison Moran, Denver, CO (US); Shuting Guo, Boulder, CO (US); Jennifer Kracha, Lafayette, CO (US); Kyle Sebo, Oceanside, CA (US); Timothy Visos-Ely, Boulder, CO (US)

(73) Assignee: Medline Industries, LP, Northfield, IL (US)

( * ) Notice: Subject to any disclaimer, the term of this patent is extended or adjusted under 35 U.S.C. 154(b) by 0 days.

(21) Appl. No.: 16/635,441

(22) PCT Filed: Jul. 13, 2018

(86) PCT No.: PCT/US2018/042125
§ 371 (c)(1),
(2) Date: Jan. 30, 2020

(87) PCT Pub. No.: WO2019/027657
PCT Pub. Date: Feb. 7, 2019

(65) Prior Publication Data

US 2020/0368097 A1 Nov. 26, 2020

Related U.S. Application Data

(60) Provisional application No. 62/540,640, filed on Aug. 3, 2017.

(51) Int. Cl.

| | |
|---|---|
| ***A61H 3/04*** | (2006.01) |
| ***A61G 5/12*** | (2006.01) |
| ***A61G 5/10*** | (2006.01) |

(52) U.S. Cl.
CPC ..... *A61H 3/04* (2013.01); *A61G 5/1005* (2013.01); *A61G 5/1091* (2016.11); *A61G 5/122* (2016.11); *A61H 2003/046* (2013.01)

(58) Field of Classification Search
CPC .... A61H 3/04; A61H 2003/046; A61G 5/122; A61G 5/1091; A61G 5/1005
(Continued)

(56) References Cited

U.S. PATENT DOCUMENTS 6,338,355 B1 * 1/2002 Cheng ..... A61H 3/04 135/67
6,481,730 B2 * 11/2002 Sung ..... A61H 3/04 280/87.05
(Continued)

FOREIGN PATENT DOCUMENTS

KR 101525944 6/2015
WO 2017079491 5/2017
WO WO-2017079491 A * 5/2017 ..... A61H 3/04

OTHER PUBLICATIONS

International Search Report and Written Opinion for International Application No. PCT/US2018/042125 dated Nov. 19, 2018.

*Primary Examiner* — John D Walters
*Assistant Examiner* — Hilary L Johns
(74) *Attorney, Agent, or Firm* — Fitch, Even, Tabin & Flannery LLP

(57) ABSTRACT

A rollator having a first side frame and a second side frame; the first side frame comprising a first side frame intervening structural portion; the second rolling side frame comprising a second side frame intervening structural portion; a central platform having a first platform side and a second platform side; and first and second track mechanisms respectively coupling the first and second side portions to the first and second platform sides of the central platform; the first and second track mechanisms permitting independent movement
(Continued)

of said first and second side frames relative to said central platform.

16 Claims, 7 Drawing Sheets

(58) Field of Classification Search
USPC ..... 280/47.38
See application file for complete search history.

(56) References Cited

U.S. PATENT DOCUMENTS 6,494,469 B1 * 12/2002 Hara ..... A61H 3/04 135/67
6,837,503 B2 * 1/2005 Chen ..... A61H 3/04 280/47.4
7,052,030 B2 * 5/2006 Serhan ..... A61H 3/04 280/304.1
8,061,376 B2 * 11/2011 Ryan ..... A61H 3/04 135/67
8,251,380 B2 * 8/2012 Liu ..... A61H 3/04 280/47.34
8,439,376 B2 * 5/2013 Willis ..... A61H 3/04 280/87.021
8,602,424 B2 * 12/2013 Liu ..... A61H 3/04 280/42
8,840,124 B2 * 9/2014 Serhan ..... B60T 7/14 280/87.021
8,936,256 B2 * 1/2015 Liu ..... A61H 3/04 280/42
8,998,223 B2 * 4/2015 Chang ..... B60T 7/08 280/87.021
9,022,413 B2 * 5/2015 Liu ..... B62B 3/02 280/651
9,173,802 B2 * 11/2015 Willis ..... A61G 5/08
9,339,432 B2 * 5/2016 Liu ..... A61H 3/04
9,415,635 B2 * 8/2016 Liu ..... B60B 33/0015
9,744,094 B2 * 8/2017 Liu ..... A61H 3/04
10,053,062 B2 * 8/2018 Liu ..... B60T 1/04
2015/0335940 A1 11/2015 Johnson
2018/0028392 A1 * 2/2018 Bisceglia ..... A61H 3/04

* cited by examiner

RECIPROCATING ROLLATOR

This application is a national stage application, filed under 35 U.S.C. § 371, of International Application No. PCT/US18/42125, filed Jul. 13, 2018, which claims the benefit of Provisional Application No. 62/540,640, filed Aug. 3, 2017, both of which are incorporated herein by reference.

TECHNICAL FIELD

The present disclosure generally relates to assistive devices for disabled, unstable, or weakened users, and more specifically to assistive devices for users with walking disabilities, or instability or weakness in the user's legs that impairs the user's ability to walk. Even more specifically, the disclosure provides relates to rollator devices for users with walking disabilities, or instability or weakness in the user's legs that impairs the user's ability to walk.

BACKGROUND

Walkers and rollators are devices that provide stability for those who may be in a weakened or unstable state, such as persons with a disability or elderly infirm persons. Such devices provide additional support to assist the user in maintaining balance or stability while walking. Conventional designs include of a frame having handles at about waist height with the depth approximating one to two times the user's typical step length. Many walkers and rollators are also height adjustable, and are equipped with amenities such as seats, shopping baskets, and pockets. Rollator handles are typically equipped with hand brakes that can be actuated by the user such as by squeezing or pulling in order to apply a braking mechanism at one or more of the wheels. The brakes can also be used to assist in turning the rollator by braking one side while turning the rollator toward that side so as to achieve a tight turning radius.

Now, a reciprocating rollator has been devised. The rollator includes a first side frame and a second side frame that can reciprocate independently of one another. In some embodiments, the rollator has a central platform having a first platform side and a second platform side. The rollator is provided with first and second track mechanisms respectively coupling the first and second side frames to the first and second platform sides of the central platform. The track mechanisms can each comprise a slot and captive retainer, such as a slider or pin, configured to travel within the first slot. The rollator may have manual brake mechanisms. In addition, to assist the user in causing reciprocating action of the side frames, the rollator can be configured with automatic brake mechanisms that engage when the side frame portions are fully extended.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
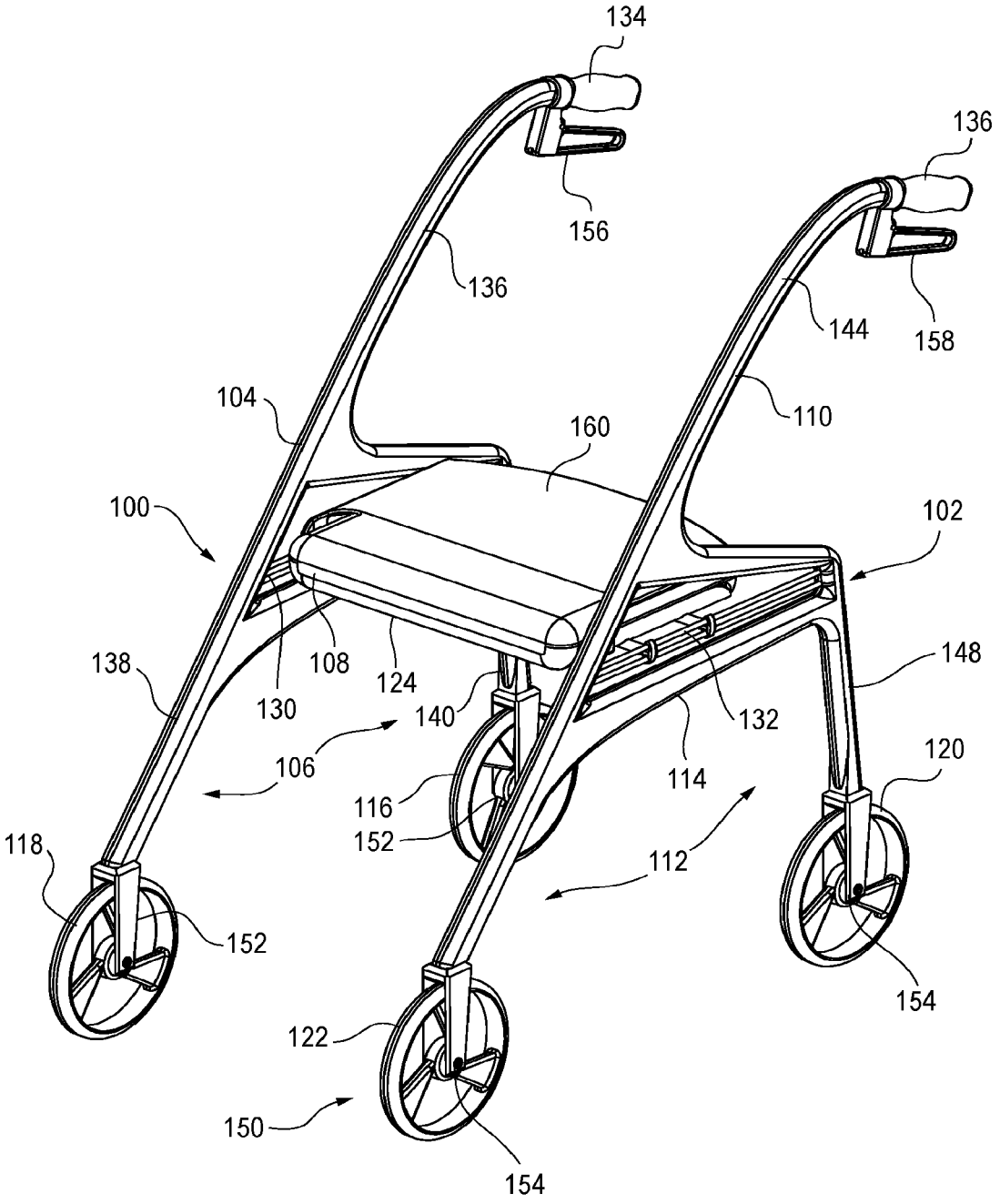
FIG. 1 is a perspective view of a rollator in accordance with one embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring to FIG. 1, shown is a first side frame 100, a second side frame 102, a first side frame upper portion 104, a first side frame lower portion 106, a first side frame intervening structural portion 108, second side frame upper portion 110, and a second side frame lower portion 112 and a second side frame intervening structural portion 114. Also shown is a first plurality of wheels 116, 118, a second plurality of wheels 120, 122, a central platform 124 having a first platform side 126 and a second platform side 128, a first track mechanism 130, and a second track mechanism 132. Further shown is a first handle 134, a first arm 136, a first front strut 138, a first rear strut 140, a second handle 142, a second arm 144, a second front strut 146, a second rear strut 148, and a ground plane 150. A first brake 152 (or first front brake and first rear brake), a second brake 154 (or second front brake and second rear brake), a first brake control 156, second brake control 158, a seat surface 160, and a seat back 162 (backrest).

The first side frame 100 is slidably coupled to the central platform 124 at the first side frame intervening structural portion 108 via the first track mechanism 130. The first side frame 100, and the second side frame 102, may, for example, be made from aluminum, steel, or other suitable materials. The first track mechanism 130, in accordance with the present embodiment, comprises a first pair of parallel rods 162, 164 (or rails) made from steel or other suitable material. The first pair of rods 162, 164 are coupled at first and second ends to the first side frame 100 intervening structure. A first pair of sliders 166, 168 is coupled to the central platform 124, and are slideably coupled to the first pair of rods. The sliders 166, 168 are configured in a captive and secure relationship with the central platform 124. One of the sliders 166 is closer to a forward edge of the central platform 124 and the other slider 168 is closer to a rearward edge of the central platform 124, both being disposed near the first side frame 100 structural portion. The first pair of rods 162, 164 each pass through respective ones of the first forward pair of bores and the first rearward pair of bores, such as a first upper forward bore and a first upper rearward bore, in the case of the first upper rod 162, and a first lower forward bore and a first lower rearward bore, in the case of the first lower rod 164.

Similarly, the second track mechanism 132, in accordance with the present embodiment, comprises a second pair of parallel rods 170, 172 (or rails) coupled at first and second ends to the second side frame 102 intervening structure. A second pair of sliders is coupled to the central platform 124, and are slidably coupled to the second pair of rods 170, 172. The second pair of sliders are generally in the form of a second pair of sliders 174, 176 configured similarly to the first pair of sliders. The second pair of rods 170, 172 each pass through respective ones of the second forward pair of bores and the second rearward pair of bores, such as a second upper forward bore and a second upper rearward bore, in the case of a second upper rod 170, and a second lower forward bore and a second lower rearward bore, in the case of a second lower rod 172.

The first track mechanism is oriented to allow relative sliding movement of the first side frame 100 relative to the central platform 124 in forward and backward directions that are parallel to the horizontal ground plane 150. Similarly, the second side frame 102 is slidably coupled to the central platform 124 at the second side frame intervening structural portion 114 via the second track mechanism. In this embodiment, the first rail and the second rail operate independently of one another so as to permit relative sliding movement between the first side frame 100 and the central platform 124 independently from permitting relative sliding movement between the second side frame 102 and the central platform 124.

The plurality of first wheels 116, 118 are coupled to the first side frame lower portion 106, and are positioned and oriented to engage with and permit the rolling of the first wheels 116, 118 along the horizontal ground plane 150. The plurality of second wheels 120, 122 are coupled to the second side frame lower portion 112, and are positioned and oriented to engage with and permit the rolling of the second wheels 120, 122 along the horizontal ground plane 150.

A front one of the plurality of first wheels 116 is, for example, coupled to a front strut of the first side frame lower portion 106, and a rear one of the plurality of first wheels 118 is, for example, coupled to a rear strut of the first side frame lower portion 106. The plurality of first wheels 116, 118 is configured to roll on a ground surface coincident with the horizontal ground plane 150 thereby permitting translation of the rollator in directions parallel to the horizontal ground plane 150. Alternatively or in addition, a front first glide may be coupled to the front strut of the first lower side frame, and/or a rear first glide may be coupled to the rear strut of the first lower side frame. The rear first glide and the front first glide may be used instead of one or more of the first plurality of wheels 116, 118.

A front one of the plurality of second wheels 120 is, for example, coupled to a front strut of the second side frame lower portion 112, and a rear one of the plurality of second wheels 122 is coupled to a rear strut of the second side frame lower portion 112. The plurality of second wheels 120, 122 is configured to roll on a ground surface coincident with the horizontal ground plane 150 thereby permitting translation of the rollator in directions parallel to the horizontal ground plane 150. Alternatively or in addition, a front second glide may be coupled to the front strut of the second lower side frame, and/or a rear second glide may be coupled to the rear strut of the second lower side frame.

In operation, a user of the rollator will step forward with, for example, the right foot and simultaneously press forward on the first (or right) handle. In response to a first forward force on the right handle, the first forward force is transferred into the first side frame 100, thereby translating the first side frame 100 in a first forward direction, the first forward direction being parallel to the horizontal ground plane 150. This translation of the first side frame 100 causes the first side frame 100 to slide forward relative to the central platform 124 along the first track mechanism 130. At or before the time the first side frame 100 reaches the maximum forward extent of the first track mechanism 130, the central platform 124 slides forward along the second track mechanism 132 relative to the second side frame 102. Preferably, the second side frame 102 is held in place (or movement is resisted) in directions parallel to the horizontal ground plane 150 relative to the ground by friction, such as through second brakes 154 at the second plurality of wheels 120, 122, by a second glide frictionally interacting with the ground, or any other resistive or locking mechanisms.

Next, the user of the rollator will step forward with the left foot and simultaneously press forward on the second (or left) handle. In response to a second forward force (as a result of this pressing) on the left handle, the second forward force is transferred into the second side frame 102, thereby translating the second side frame 102 in a second forward direction, the second forward direction being parallel to the horizontal ground plane 150. This translation of the second side frame 102 causes the second side frame 102 to slide forward relative to the central platform 124 along the second track mechanism 132. At or before the time the second side frame 102 reaches the maximum forward extent of the second track mechanism 132, the central platform 124 slides forward along the first track mechanism 130 relative to the first side frame 100. Preferably, the first side frame 100 is held in place (or movement is resisted) in directions parallel to the horizontal ground plane 150 relative to the ground by friction, such as through first brakes 152 at the first plurality of wheels 116, 118, by a first glide frictionally interacting with the ground, or by other resistive or locking mechanisms.

This reciprocating process continues in an alternating, repeating fashion until such time as the user has moved relative to the horizontal ground plane 150 sufficiently to reach a destination.

In the event the user wishes to turn to steer the rollator, such as in a right (or first) direction the pressing forward on the first (or right) handle is attenuated, thereby reducing the amount and/or duration of the force transferred to the first side frame 100, and further thereby reducing the amount of the translating of the first side frame 100 in the first forward direction. Additionally, or alternatively, the brakes at the first plurality of wheels 116, 118 may be used to counter the pressing forward of the first (or right) handle, thereby reducing the net amount of the force transferred to the first side frame 100 in the first forward direction. By attenuating or reducing the amount or duration of the force transferred to the first side frame 100 (without also attenuating or reducing the amount or duration of the force transferred to the second side frame 102), a turn in a first (or right) direction is effected. In the event the user wishes to turn to steer the rollator, in a left (or second) direction, the converse motions or actions are taken.

Figure 2:
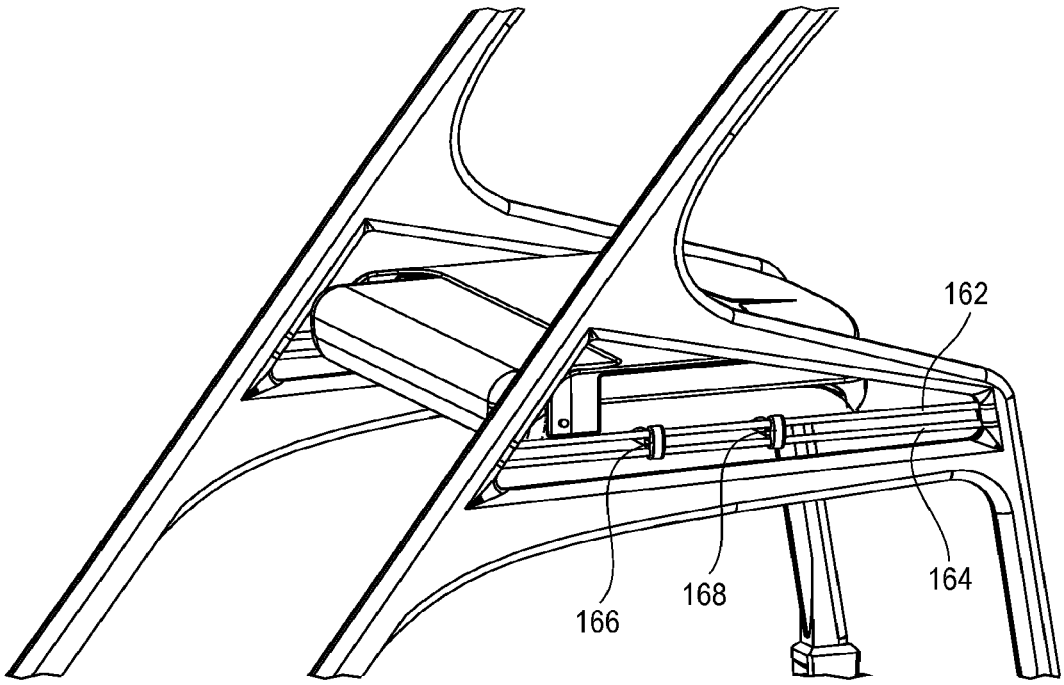
FIG. 2 is a relatively enlarged perspective view of the embodiment of FIG. 1 particularly illustrating a first variation of a track mechanism.

Referring next to FIG. 2, the first side frame 100 is slidably coupled to the central platform 124 at the first side frame intervening structural portion 108 via a first rail of the first track mechanism 130. The first rail is oriented to allow relative sliding movement between the first side frame 100 and the central platform 124 parallel to the horizontal ground plane 150. Similarly, the second side frame 102 is slidably coupled to the central platform 124 at the second side frame intervening structural portion 114 the second rail of the second track mechanism 132. The second rail is oriented to allow relative sliding movement between the second side frame 102 and the central platform 124 parallel to the horizontal ground plane 150. The first rail and the second rail operate independently of one another so as to permit relative slidable movement between the first side frame 100 and the central platform 124 independently from permitting relative slidable movement between the second side frame 102 and the central platform 124, thereby permitting reciprocating action by the user.

Figure 3:
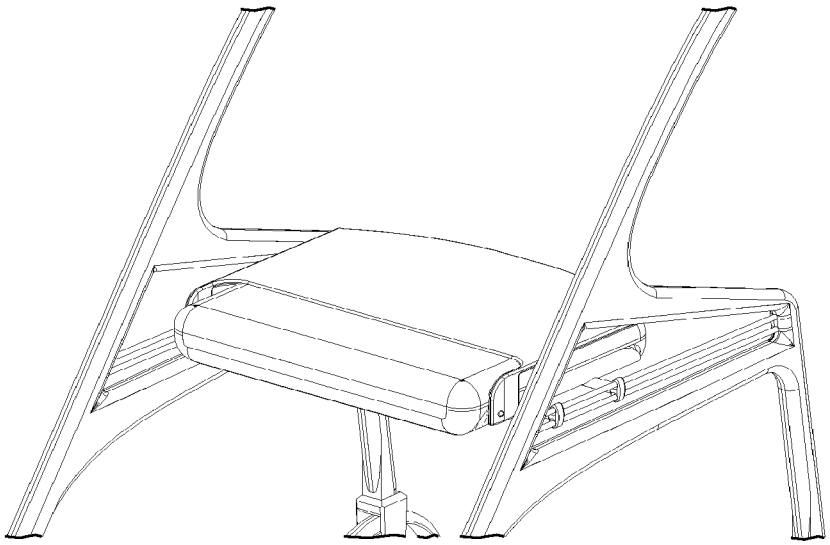
FIG. 3 is a relatively enlarged perspective view of the embodiment of FIG. 1 particularly illustrating a foldable backrest in a folded position.
Figure 4:
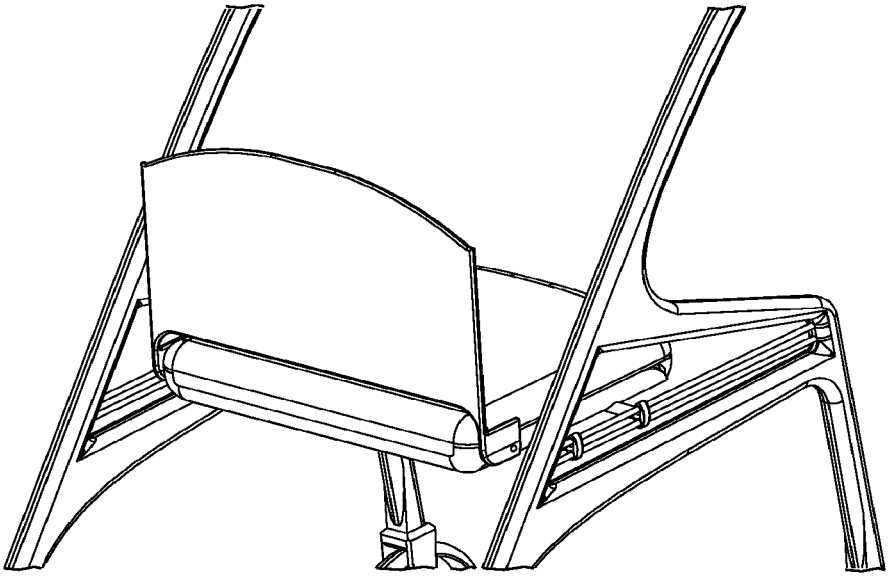
FIG. 4 is a close-up perspective view of the embodiment of FIG. 1 particularly illustrating the foldable backrest in an upright position.

The backrest is pivotally coupled to the central platform 124 adjacent to a seating surface, such as at a leading edge of the seating surface. Such rotatable coupling may be, for example, via a pair of hinges (one shown as hinge 202). In a folded position, the backrest lies parallel to the seat surface 160, and in a deployed position the backrest is upright relative to the seat surface, such as normal to the seat surface or at an obtuse angle to the seat surface. The backrest is illustrated in the folded position in FIGS. 2 and 3. In operation, the user deploys the backrest into a deployed position (FIG. 4) by rotating the backrest from the folded position into the deployed position at the pair of hinges.

Figure 5:
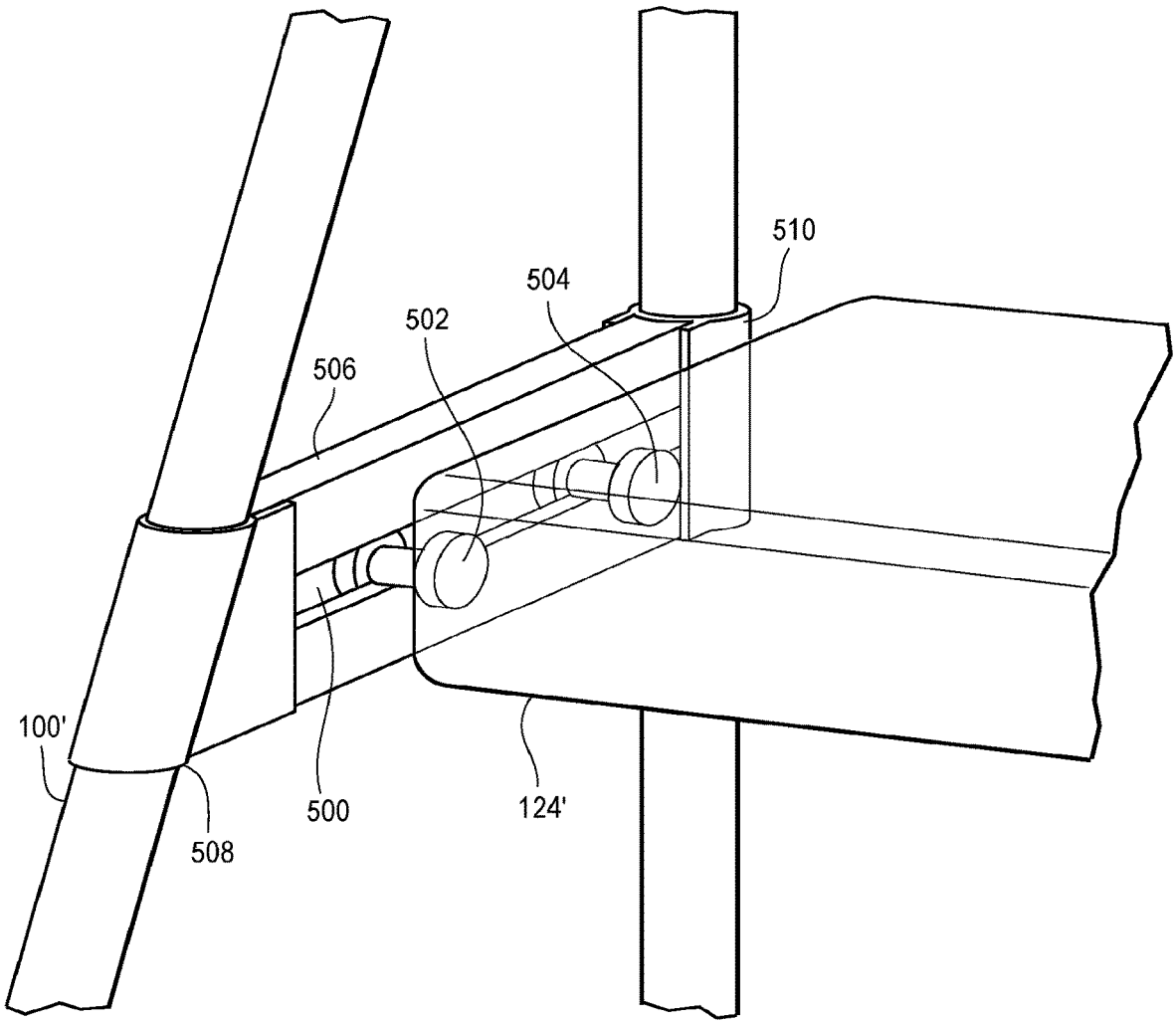
FIG. 5 is a perspective view of a rollator in accordance with another embodiment of the present invention.
Figure 6:
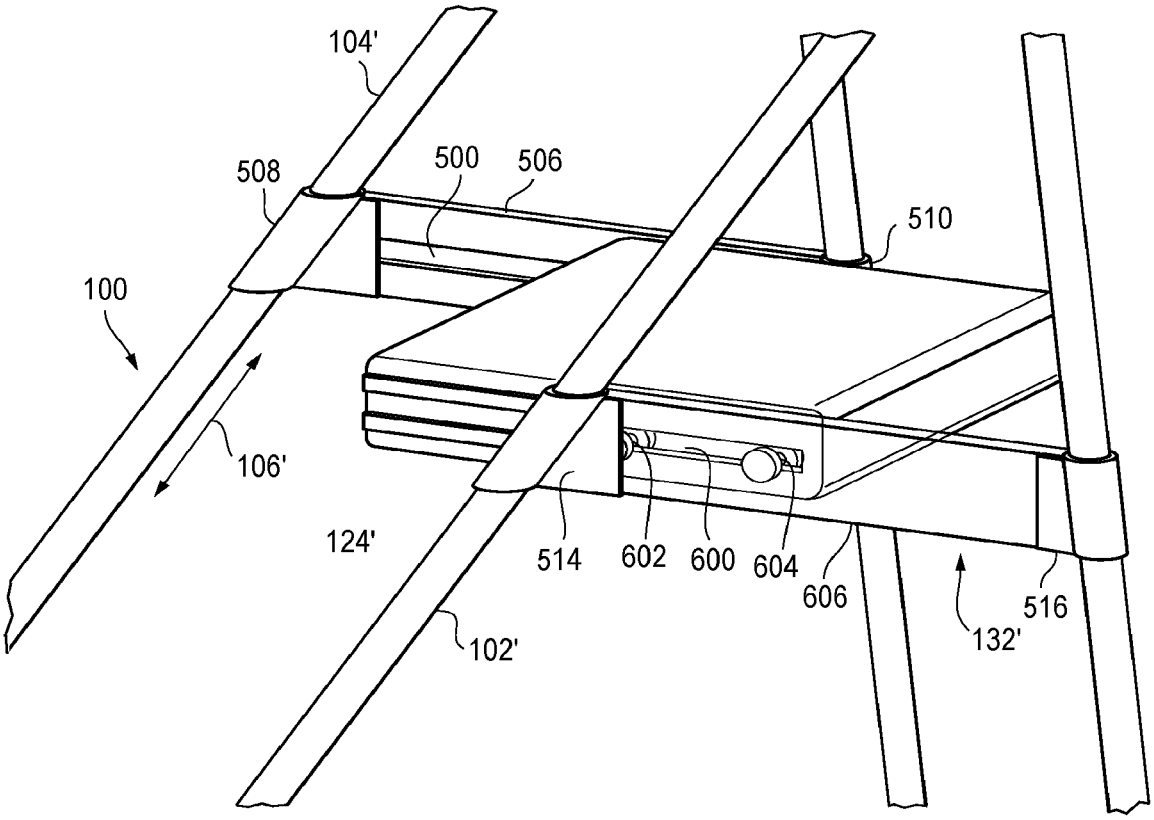
FIG. 6 is a second perspective view of the embodiment of FIG. 5.

Referring next to FIGS. 5 and 6, a perspective view is shown of an alternative embodiment particularly illustrating a second variation of the track mechanism. Shown is a first side frame 100', a first side frame upper portion 104', and a first side frame lower portion 106. Also shown is a central platform 124'.

The rollator first track mechanism 130', in accordance with the present embodiment, comprises a first slot 500, a first forward captive pin 502, and a first rearward captive pin 504. The first slot is in a channel 506 that is coupled to the first side frame 100' at forward bracket 508 and rear bracket 510. The first forward captive pin is enveloped by the first slot and is constrained to slide (or travel) with in the first slot in a forward and rearward direction (parallel to the horizontal ground plane 150') relative to the central platform 124'. The first rearward captive pin, which is behind first forward captive pin, is likewise enveloped by the first slot and is constrained to slide (or travel) within the first slot in a forward and rearward direction (parallel to the horizontal ground plane 150') relative to the central platform 124'. Alternatively, the slot may be coupled to or form part of the central platform, and the captive pins may be coupled to or form part of the first side frame intervening structural portion.

The second track mechanism 132' is a mirror image of the first track mechanism 130' and comprises a second slot 600, a second forward captive pin 602, and a second rearward captive pin 604. The second slot is in a second channel 606 that is connected to the second side frame 102' at brackets 514, 516. The second forward captive pin is enveloped by the second slot and is constrained to slide (or travel) within the second slot in a forward and rearward direction (parallel to the horizontal ground plane 150') relative to the central platform 124'. The second rearward captive pin, which is behind the second forward captive pin, is enveloped by the second slot and is constrained to slide (or travel) within the second slot in a forward and rearward direction (parallel to the horizontal ground plane 150" relative to the central platform 124'.

Figure 11:
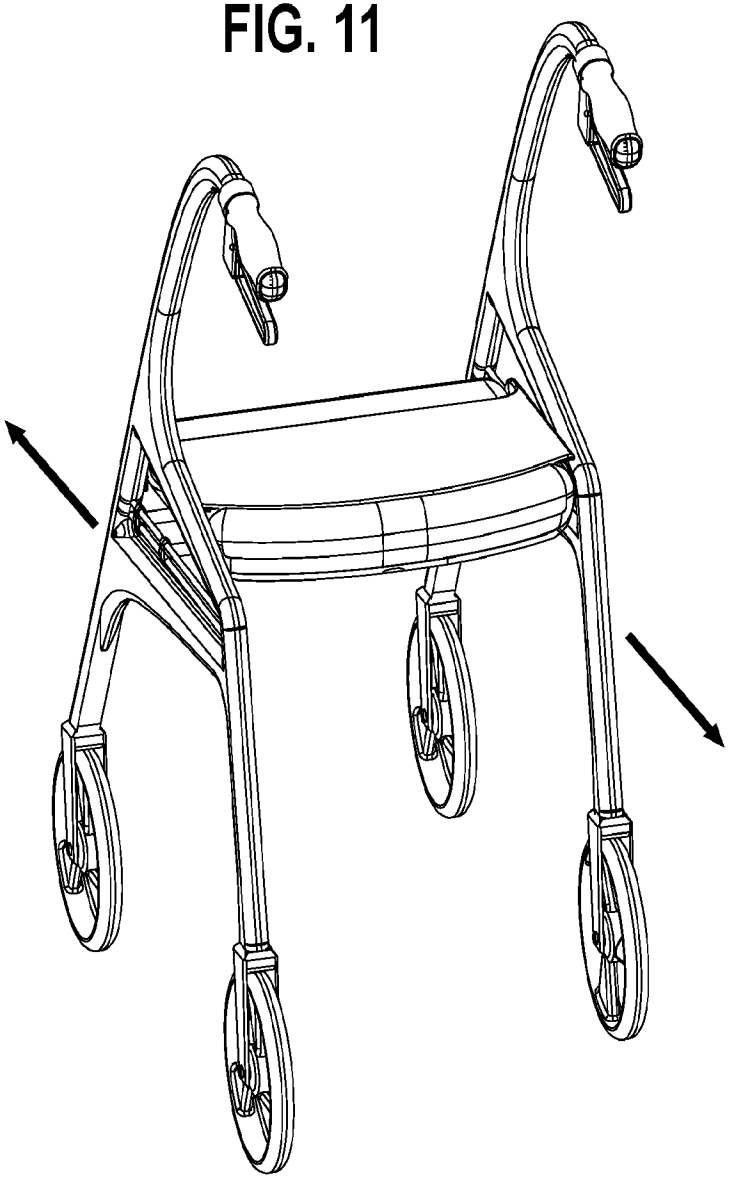
FIG. 11 is a perspective view of the rollator of FIG. 5, illustrating a configuration in which the first frame is in a relatively retracted position, and the second frame is in a relatively advanced position.
Figure 10:
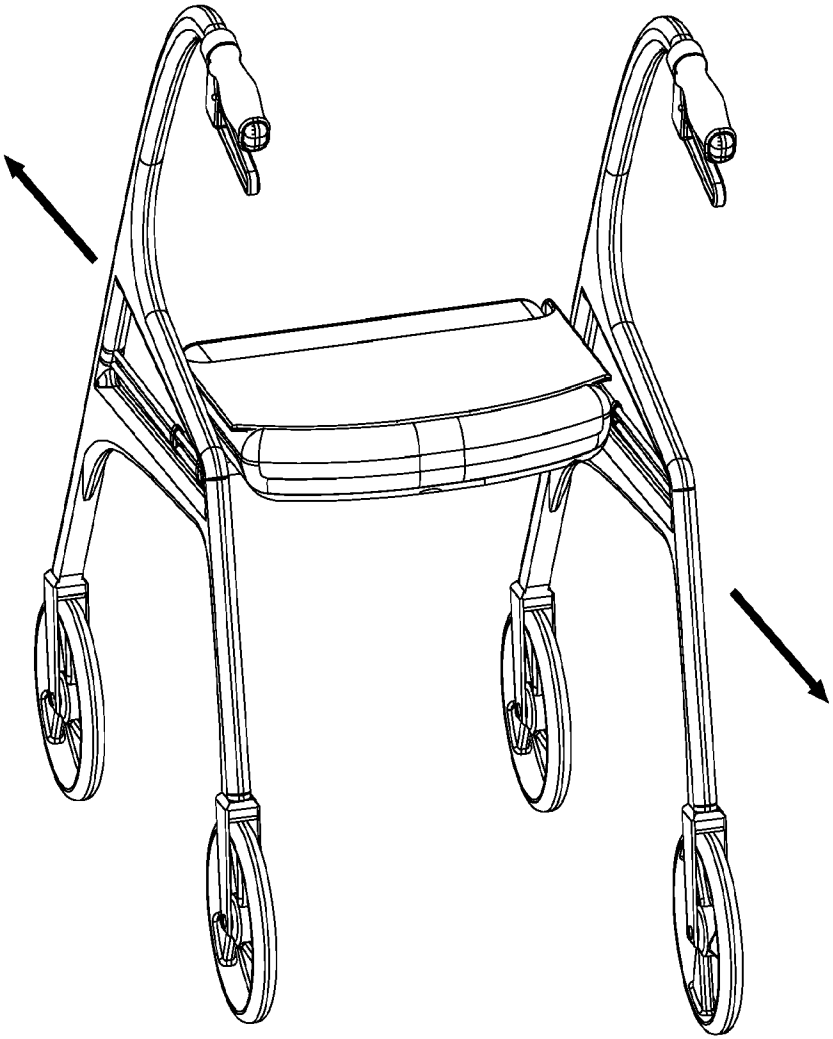
FIG. 10 is a perspective view of the rollator of FIG. 5, illustrating a configuration in which the first frame is in a relatively advanced position, and the second frame is in a rearward position.

Via the above mechanisms, the first and second side frames are again slidable with respect to the central platform independently of one another, as seen with reference to FIGS. 10 and 11. The user operates the device in reciprocating fashion as described above.

Figure 9:
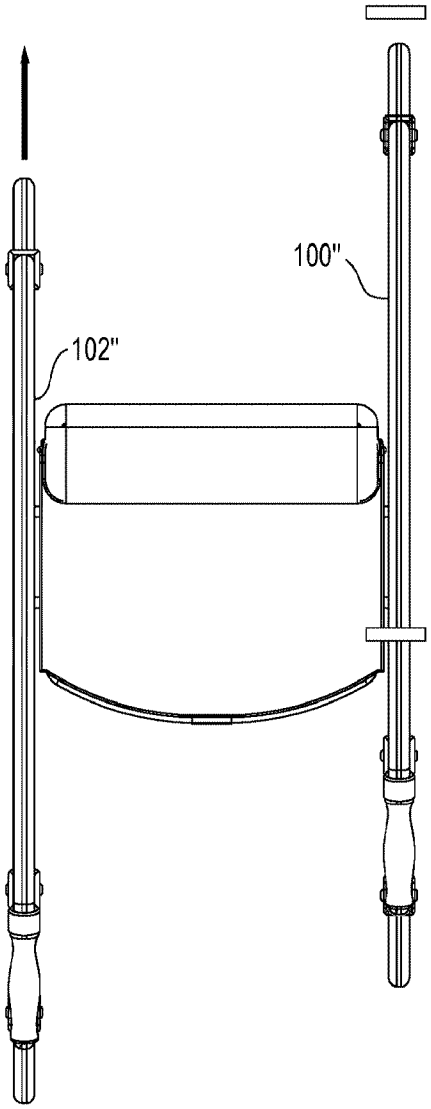
FIG. 9 is a top view of the rollator of FIG. 7 illustrating the rollator with the first side frame fully advanced and the first automatic brake mechanism engaged.
Figure 8:
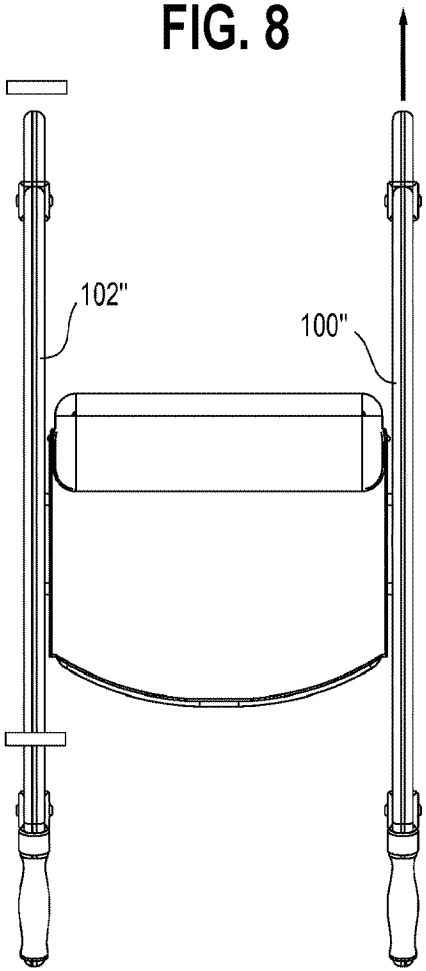
FIG. 8 is a top view of the rollator of FIG. 7 illustrating partial advancement of the first (right side) frame.
Figure 7:
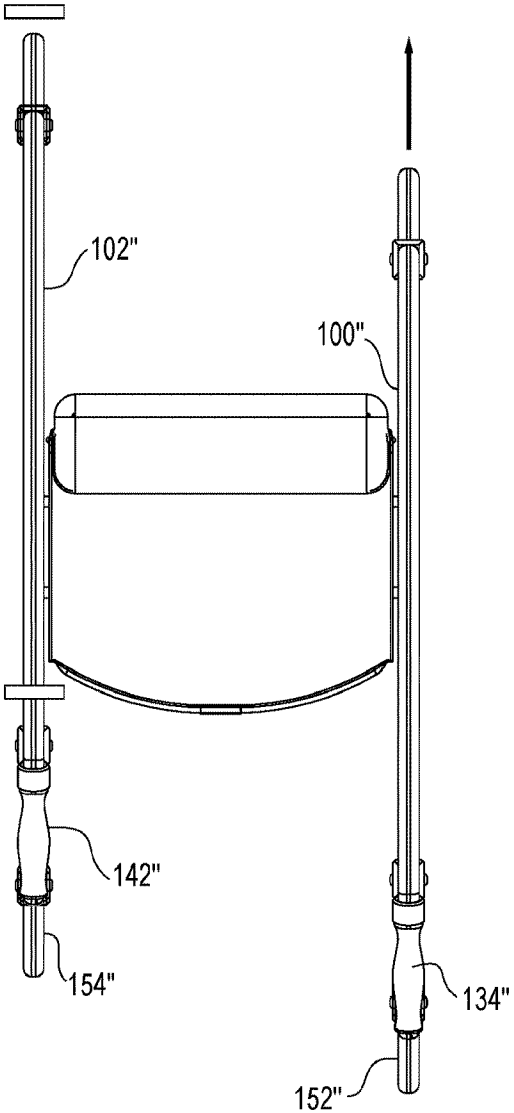
FIG. 7 is a top view of a rollator in accordance with another embodiment, illustrating the rollator with the second automatic brake mechanism engaged.

Referring next to FIGS. 7-9, the illustrated rollator is provided with a pair of automatic brake mechanisms in addition to the manual brake mechanism of the heretofore-described rollators. The rollator includes a first side frame 100" and a second side frame 102", as well as wheels, central platform, seat surface, backrest, and track mechanisms substantially as described above with regard to FIG. 1 or FIG. 5. Further shown is a first manual brake handle 134" and, a second manual brake handle 142"

The rollator of this embodiment is configured with a pair of automatic brake mechanisms, one associated with the first side frame 100" and a second associated with a second side frame portion 102". The brake portions are configured to lock the wheels on alternative sides of the rollator to assist the user in reciprocally operating the device. With reference to FIG. 7, the automatic brake mechanism on the second (left) side of the rollator has been engaged, which will inhibit rolling travel of the second side frame 102" relative to the ground. As the user strides forward, the user maintains a grasp on the left and right handle portions 134", 142", and manually advances the right handle portion 12" with respect to the ground and consequently also with respect to the left side frame 102", which is at this point held in a stationary position with respect to the ground. The right side portion advances through the range of travel beginning with FIG. 7, through the intermediate portion depicted in FIG. 8, and to the fully advanced position depicted in FIG. 9. At this point, the automatic brake mechanism associated with the first side frame portion 100" engages, and the automatic brake mechanism that is associated with the second side frame portion 102" disengages. This inhibits rolling of the ride side frame relative to the ground and allows the user to manually advance the left side frame. Via the above mechanisms the user is assisted in operating the rollator in reciprocating fashion.

It is thus seen that a rollator that provides a reciprocating action is provided.

While the invention herein disclosed has been described by means of specific embodiments, examples and applications thereof, numerous modifications and variations could be made thereto by those skilled in the art without departing from the scope of the invention set forth in the claims.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A rollator comprising:

a first side frame and a second side frame;

said first side frame comprising a first side frame upper portion and a first side frame lower portion and a first side frame intervening structural portion; said second side frame comprising a second side frame upper portion and a second side frame lower portion and a second side frame intervening structural portion;

plural first wheels disposed on said first side frame proximal said first side frame lower portion and plural second wheels disposed on said second side frame proximal said second side frame lower portion;

a central platform having a first platform side and a second platform side; and first and second track mechanisms respectively coupling the first and second side portions to the first and second platform sides of the central platform;

the first track mechanism comprising a first slot and first captive retainer configured to travel within said first slot, one of said first slot and first captive retainer being disposed on said first platform side and the other of said first slot and first captive retainer being disposed on said first side frame intervening structural portion;

the second track mechanism comprising a second slot and second captive retainer configured to travel within said second slot, one of said second slot and second captive retainer being disposed on said second platform side and the other of said second slot and second captive retainer being disposed on said second side frame intervening structural portion;

said first and second track mechanisms permitting reciprocating movement of said first and second side frames relative to said central platform; and a first automatic brake mechanism that engages when said first side frame is fully extended and a second automatic brake mechanism that engages when said second side frame is fully extended.

2. The rollator of claim 1, including at least one manually actuated hand brake mechanism.

3. The rollator of claim 1, said first automatic brake mechanism disengaging when said second side frame is fully extended and said second automatic brake mechanism disengaging when said first side frame is fully extended.

4. A method comprising:

providing a rollator, said rollator comprising a first side frame and a second side frame;

said first side frame comprising a first side frame upper portion and a first side frame lower portion and a first side frame intervening structural portion; said second side frame comprising a second side frame upper portion and a second side frame lower portion and a second side frame intervening structural portion;

plural first wheels disposed on said first side frame proximal said first side frame lower portion and plural second wheels disposed on said second side frame proximal said second side frame lower portion;

a central platform having a first platform side and a second platform side; and first and second track mechanisms respectively coupling the first and second side portions to the first and second platform sides of the central platform;

the first track mechanism comprising a first slot and first captive retainer configured to travel within said first slot, one of said first slot and first captive retainer being disposed on said first platform side and the other of said first slot and first captive retainer being disposed on said first side frame intervening structural portion;

the second track mechanism comprising a second slot and second captive retainer configured to travel within said second slot, one of said second slot and second captive retainer being disposed on said second platform side and the other of said second slot and second captive retainer being disposed on said second side frame intervening structural portion;

said first and second track mechanisms permitting independent movement of said first and second side frames relative to said central platform;

grasping said first side frame and said second side frame;

while walking, manually reciprocating said first and second side frames relative to one another;

engaging a first automatic brake mechanism when said first side frame is fully extended; and engaging a second automatic brake mechanism when said second side frame is fully extended.

5. A rollator comprising:

a left frame comprising:

a left handle, a left arm coupled to the left handle, a left rail coupled to the left arm, wherein the left rail is oriented in a substantially horizontal orientation, a left front strut coupled to the left rail and extending toward a horizontal ground plane, and a left rear strut coupled to the left rail and extending toward the horizontal ground plane;

a right frame comprising:

a right handle, a right arm coupled to the left handle, a right rail coupled to the left arm, wherein the left rail is oriented in the substantially horizontal orientation, a right front strut coupled to the left rail and extending toward the horizontal ground plane, and a right rear strut coupled to the left rail and extending toward the horizontal ground plane;

a body frame sideably coupled to the right rail and allowing horizontal relative movement between the body frame and the right rail, and coupled to the left rail and allowing horizontal relative movement between the body frame and the left rail;

a right automatic brake mechanism that engages when said right frame is fully extended; and a left automatic brake mechanism that engages when said left frame is fully extended.

6. The rollator of claim 5 further comprising:

a right wheel coupled to the right frame and interposed between the right frame and the horizontal ground plane; and a left wheel coupled to the left frame and interposed between the left frame and the horizontal ground plane.

7. The rollator of claim 6 further comprising;

another right wheel coupled to the right frame and interposed between the right frame and the horizontal ground plane; and another left wheel coupled to the left frame and interposed between the left frame and the horizontal ground plane.

8. The rollator of claim 7 further comprising:

a left brake coupled to the left wheel, wherein the left brake selectively brakes the left wheel in response to the left automatic brake mechanism; and a right brake coupled to the right wheel, wherein the right brake selectively brakes the right wheel in response to the right automatic brake mechanism.

9. The rollator of claim 8 further comprising:

a left brake control coupled to the left handle, wherein the left brake control selectively controls the left brake; and a right brake control coupled to the right handle, wherein the right brake control selectively controls the right brake.

10. The rollator of claim 5 further comprising:

a seat surface coupled to the body frame.

11. The rollator of claim 5:

wherein the left rail comprises a left slot oriented in the substantially horizontal orientation, and wherein the body frame is coupled to the left rail with a left pair of rollers; and wherein the right rail comprises a right slot oriented in the substantially horizontal orientation, and wherein the body frame is coupled to the right rail with a right pair of rollers.

12. The rollator of claim 5:

wherein the body frame comprises a left rail track coupled to a left pair of rollers; and wherein the body frame comprises a right rail track coupled to a right pair of rollers.

13. The rollator of claim 5:

wherein the right rail comprises a right pair of bars oriented in the substantially horizontal orientation, and wherein the body frame is coupled to the right pair of bars with two right pairs of slides; and wherein the left rail comprises a left pair of bars oriented in the substantially horizontal orientation, and wherein the body frame is coupled to the left pair of bars with two left pairs of slides.

14. The rollator of claim 5 further comprising:

a backrest coupled to the body frame.

15. The rollator of claim 5 further comprising:

a backrest pivotally coupled to the body frame.

16. A method of using a rollator comprising:

receiving a first forward force through a right handle;

transferring the first forward force to a right frame through the right handle thereby translating the right frame in a forward direction;

sliding the right frame relative to a body frame along a right track thereby moving the right frame forward relative to the body frame, and thereby moving the body frame forward relative to a left frame by sliding the body frame along a left track;

stopping the receiving of the first forward force through the right handle;

receiving a second forward force through a left handle;

transferring the second forward force to the left frame through the left handle thereby translating the left frame in the forward direction;

sliding the left frame relative to the body frame along the left track thereby moving the left frame forward relative to the body frame, and thereby moving the body frame forward relative to the right frame by sliding the body frame along the right track;

stopping the receiving of the second forward force through the left handle;

engaging a left automatic brake mechanism when said left frame is fully extended; and engaging a right automatic brake mechanism when said right frame is fully extended.

* * * * *